United States Patent [19]

Doubt

[11] 4,007,928

[45] Feb. 15, 1977

[54] GOLFER'S COMBINATION TOOL

[76] Inventor: John J. Doubt, 2515 Carlmont Drive, Belmont, Calif. 94002

[22] Filed: Oct. 23, 1975

[21] Appl. No.: 625,069

[52] U.S. Cl. ..... 273/32 B; 273/32 A; 223/118

[51] Int. Cl.[2] ..... A63B 57/00; A47J 51/02

[58] Field of Search ..... 273/32 B, 32 R, 32 A; D86/10 D; 223/118, 119

[56] References Cited

UNITED STATES PATENTS

| | | | |
|---|---|---|---|
| 821,049 | 5/1906 | Mason | 223/118 |
| 1,213,948 | 1/1917 | Redheffer | 223/118 |
| 1,522,922 | 1/1925 | Smiley | 223/118 |
| 2,300,866 | 11/1942 | Bernstein | D86/10 D |
| 3,622,157 | 11/1971 | Hatch | 273/32 B X |
| 3,744,542 | 7/1973 | Stephens et al. | 273/32 B X |
| 3,866,749 | 2/1975 | Stainer | 273/32 A X |

*Primary Examiner*—George J. Marlo
*Attorney, Agent, or Firm*—Gerald L. Moore

[57] ABSTRACT

A combination tool for use by golfers which serves as a shoe horn and a divot repair device. In addition the tool can serve as a prop for a club which the golfer desires to lay aside to keep the handle out of contact with the ground.

2 Claims, 4 Drawing Figures

GOLFER'S COMBINATION TOOL

BACKGROUND OF THE INVENTION

Experience has shown that a golfer routinely performs two functions a multiplicity of times during a round of golf. In the first instance he will change his shoes prior to starting the match because golfing shoes having spikes cannot be worn enroute to the course. Of course he will also change his shoes after the match and possibly in between rounds if he cares to visit a dining room or other place where spiked shoes are prohibited.

In addition a good golfer repairs numerous divots in the greens during every round of golf. Whether the divots result from the landing of his own ball, the ball of his playing companions or from previous players, he will routinely repair the surface to assure a straight path during his putting or the putting of others.

In addition when the golfer approaches a green it is not uncommon for him to carry two clubs and leave the golf bag behind. Frequently the next tee is back in the general direction from which he approaches the green and if the ball is just off the green he might carry a short iron club along with his putter. This means that the player will lay one club on the ground while using the other and if the ground is damp, the club handle can become wet thereby adversely affecting the player's grip. It is therefore the object of the present invention to provide a tool for use by golfers which serves as a combination shoe horn and divot repair device. In addition the tool can be used as a prop on which the club can be rested to keep the grip from touching the ground.

Figure 1:
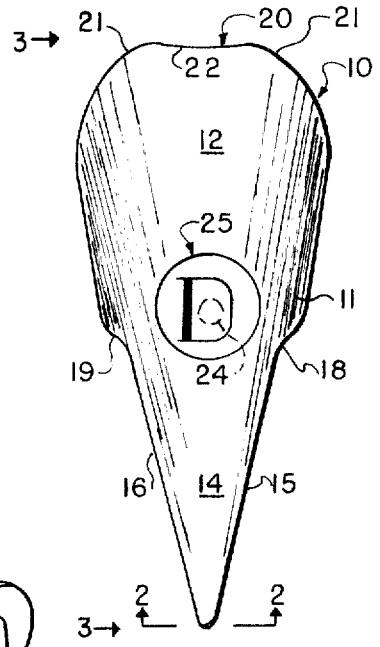
FIG. 1 is a plan view of the combination tool.

FIG.. 3 is a side edge view along the line 3—3 of FIG. 1; and

Figure 4:
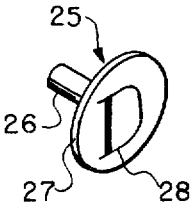

FIG. 4 is one type of golf ball marker.

DESCRIPTION OF THE INVENTION

As shown in the drawings, the tool comprises an elongated thin planar member 11 having the one end 12 formed as a shoe horn and the other end 14 formed to serve as a divot repair device. In this manner the golfer is provided with a combination tool which can be easily carried in the pocket yet can be used in performing those functions which he must do in the normal performance in a game of golf.

Figure 2:
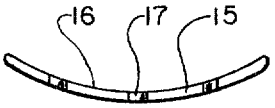
FIG. 2 is an edge view along the line 2—2 of FIG. 3.
Figure 3:
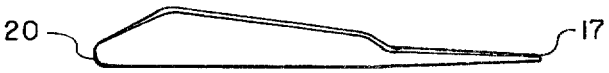

Turning now to a description of the end 12 of the tool, this end is more or less rectangular in cross-section when the tool is viewed as shown in FIG. 1. The tool has an arcuate cross-section throughout the entire length in the elongated direction as shown in FIG. 2. The arcuate configuration is similar to that of a normal shoe horn in that the arc is formed to fit along the inside surface of an adult-sized shoe. Thus in the preferred embodiment the tool is of the size shown in the drawings. To serve as a shoe horn the tool preferably is made of metal or plastic or other such rigid material which is lightweight yet can be carried easily in the pocket.

The other end 14 which serves as a divot repair device is formed with the edges 15 and 16 extending in the elongated direction and converging to at least one blunted point 17. The edges 15 and 16 connect with the shoe horn and at the shoulders 18 and 19. Thus by grasping the one end 12 of the tool and driving the point 17 into the putting green surface adjacent a divot, prying down on the one end will serve to raise the ground beneath the divot by pushing the end 14 upward. The fact that this end is slightly arcuate assists substantially in holding the ground so that the divot depression is lifted and once again filled with the earth beneath it which previously had been compressed or pushed to one side. Of course more than one point 17 can be formed by parallel extending ends 14 if desired.

In accordance with another feature of the invention the tool can serve as a prop for maintaining the grips of a club off of the ground when the club is laid aside. For this purpose the tool is pushed into the ground by gripping the one end 12 and forcing the point 17 vertically downward. The point is submerged until ground level is somewhere along the edges 15 and 16 or adjacent the shoulders 18 or 19 such that the one end 12 forming a shoe horn extends vertically upward. The end 20 extending transverse to the elongated length of the tool at the one end 12 of the tool is formed in a slightly concave configuration such that the corners 21 extend slightly higher than the edge midpoint 22. Thus when the tool is pushed into the ground a golf club can be laid such that the grip rests within the depression and adjacent the point 22. The concave configuration prevents the club from slipping off one side of the tool with the one end 12 of the tool extending upward sufficiently above ground level to maintain the club grip above the grass of the golf course. Thus the grip is prevented from touching the ground and becoming damp or dirty when the club is temporarily laid aside. Not incidentally, the club in this attitude is easily found or noticed and is less likely to be left behind after play is completed at the green.

In accordance with another feature of the invention a small center hole 24 is extended through the tool at a position roughly centered between the shoulders 18 and 19. There can be inserted into this hole a standard golf ball marking device 25 such as the one shown in FIG. 4 having a small end 26 and the larger marking end 27. The small end 26 is sized to fit within the hole 24, thus permitting the player not only to locate the marker easier because of the size of the tool but also to use the tool as a handle for the marker. Indicia 28 is located on the marking end for imprinting a golf ball with a distinctive mark of the player. In this manner the golfer is provided with a very useful tool to assist in playing the game of golf which tool is inexpensive to manufacture yet effective in use.

The invention claimed:

1. A golfer's combination tool comprising:

an elongated thin member having an arcuate cross-section along the entire length;

one end of said elongated member being sufficiently wide and of a curvature to fit within the inside of a normal shoe and thereby serve as a shoe horn;

the other end of said elongated member having edges extending in the elongated direction converging to at least one point whereby said tool can be used a shoe horn by grasping the other end and sliding the one end into a shoe adjacent the heel and the tool can also be used to repair divots in the putting surface by grasping the one end and pushing the other end into the ground next to a divot and pivoting the tool relative to the ground; and one end of the tool including an edge extending normal to the elongated length of a slight concave configuration such that by pushing the other end of the tool vertically into the ground a golf club handle can be rested on the concave end thereof and be maintained off the ground.

2. A golfer's combination tool as defined in claim 1 including an opening near the center of the elongated member of sufficient size to permit insertion of a golf ball marker, in combination with a golf ball marker fixed into said hole.

* * * * *